United States Patent [19]

Miyamoto

[11] 4,437,719

[45] Mar. 20, 1984

[54] CONNECTOR FOR AUTOMOTIVE IGNITION DEVICES

[75] Inventor: Yoshimi Miyamoto, Toyota, Japan

[73] Assignee: Nippondenso Company Limited, Kariya, Japan

[21] Appl. No.: 386,399

[22] Filed: Jun. 8, 1982

Related U.S. Application Data

[63] Continuation of Ser. No. 138,920, Apr. 10, 1980, abandoned.

[30] Foreign Application Priority Data

Jun. 13, 1979 [JP] Japan ..... 54-074354

[51] Int. Cl.[3] ..... H01R 13/52

[52] U.S. Cl. ..... 339/91 R; 339/26; 339/94 R; 339/116 C

[58] Field of Search ..... 339/26, 94 R, 94 M, 339/116 R, 116 C, 91 R; 123/143 C; 200/19 DC, 19 WG; 174/138 F, 74 A, 77 S

[56] References Cited

U.S. PATENT DOCUMENTS

| | | | |
|---|---|---|---|
| 1,748,650 | 2/1930 | Hollenbeck | 339/94 R |
| 1,999,118 | 4/1935 | Simsack | 339/26 |
| 2,131,066 | 9/1938 | Obermaier | 339/94 R |
| 2,358,971 | 9/1944 | Hallett | 200/19 WG |
| 2,464,533 | 3/1949 | Shearer | 200/19 DC |
| 2,704,355 | 3/1955 | Holton | 174/77 S |
| 3,002,126 | 9/1961 | Noir | 339/26 |
| 3,646,250 | 2/1972 | Estes | 339/26 |
| 4,139,727 | 2/1979 | Kuballa | 339/210 M |

*Primary Examiner*—John McQuade

*Attorney, Agent, or Firm*—Cushman, Darby & Cushman

[57] ABSTRACT

A terminal of a high tension voltage generated by an ignition device is embedded in a connector structure having a housing which is open at one end thereof to permit the terminal of a conductor to make an electrical connection with the embedded terminal. A sealing member of an elastic material is seated in the space between the conductor and the interior walls of the housing. A cup-shaped cover member is mounted about the conductor to enclose the housing and held in position so that it provides a pressure contact with the sealing member to fluid-tightly seal the terminals from the outside.

10 Claims, 2 Drawing Figures

CONNECTOR FOR AUTOMOTIVE IGNITION DEVICES

This is a continuation of application Ser. No. 138,920, filed Apr. 10, 1980 now abandoned.

BACKGROUND OF THE INVENTION

The present invention relates generally to ignition systems of automotive vehicles, and in particular to an improved connector for providing water-proof electrical connection between high tension voltage terminals.

In conventional automotive ignition devices such as distributors and ignition coils, one or more connecting parts of a tower-like configuration are provided for purposes of connecting the terminal of high tension voltage to a mating terminal of a conductor leading to the spark plug of an internal combustion engine. These terminals are enclosed fluid-tightly by means of a sealing member of an elastic material to prevent the leakage of the high tension voltage to the outside. Since the sealing member of the conventional connector is exposed to the outside and its material tends to oxidize due to the exposure, the elasticity of the sealing member loses its quality as a function of time with the eventual loss of its sealing function, causing a high voltage leakage when water penetrates into the terminals through the worn-out sealing member.

SUMMARY OF THE INVENTION

Accordingly, the primary object of the present invention is to provide an improved connector structure for automotive ignition systems wherein water-proof electrical connection is ensured between the terminals of high tension voltage for an extended period of time.

The connector of the invention comprises a housing which is open at one end and a terminal disposed in a position adjacent the other end of the housing, the terminal being electrically connected to an ignition device such as ignition coil for making an electrical connection with the terminal of a conductor leading to an associated spark plug of an internal combustion engine through the interior of the housing. A sealing member of an elastic material is fitted into the space between the conductor and the interior walls of the housing. A cup-shaped cover member is mounted to enclose the top and side walls of the housing and firmly secured in position so that the sealing member is pressed toward the terminals by the top wall of the cover member to assure fluid-tight sealing contact between the conductor and the interior walls of the housing. Preferably, the cup-shaped cover member is formed of a material which is resistant to oxidation. Because of the enclosing structure of the cover member, the sealing member is completely protected from the outside, so that its elasticity is retained for an extended period of time to ensure fluid-tight sealing for the terminals.

BRIEF DESCRIPTION OF THE DRAWINGS

This and other objects, advantages and features of the invention will become readily apparent from the following detailed description taken in conjunction with the accompanying drawings, in which.

DETAILED DESCRIPTION

Figure 1:
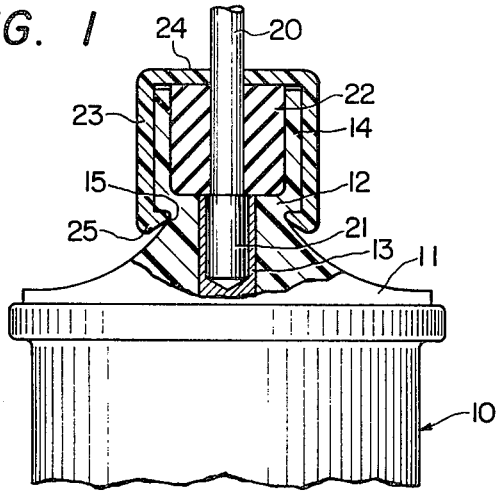
FIG. 1 is an illustration of a partially broken view of a first embodiment of the connector structure of the invention.

Referring now to FIG. 1 in which a first embodiment of the present invention is illustrated. A cap 11, which is formed of an insulative material is secured to the ignition coil 10. This cap is shaped to have a decreasing cross-section in a direction away from the coil 10 to form a tower-like connecting part 12. The latter extends upwardly to form a cylindrical housing 14 which is open at the upper end. An insulated electrical wire or conductor 20 with a male terminal 21 attached thereto extends through the housing for making an electrical connection with a female terminal 13 embedded in the cap 11 to carry the high tension spark current for utilization in an automotive ignition system, for example, an ignition distributor. The female terminal 13 is of a cylindrical shape and disposed coaxially with respect to the cylindrical body 14 and axially displaced therefrom so that the end of the conductor 20 remains extended through the interior of the cylindrical body 14. As shown in FIG. 1, the inner diameter of the housing 14 is greater than the inner diameter of the female terminal 13, and the diameter of the male terminal 21 is greater than the diameter of the conductor 20.

The inner diameter of the housing 14 is much greater than the outer diameter of the conductor 20 so that an annular space is defined between them. In the annular space is accommodated a sleeve or sealing body 22 of an insulative, elastic material, such as rubber, for purposes of fluid-tightly sealing the terminals 13 and 21. This sealing body has an outer diameter substantially equal to the inner diameter of the cylindrical housing 14 and an axial dimension slightly greater than the axial dimension of the interior of the cylindrical housing 14, as clearly shown in FIG. 1.

A cup-shaped cover member 23 is mounted about the conductor 20 to enclose the top and side walls of the connecting part 12. This cover member is formed of a material which is resistant to oxidation, such as synthetic resin (polypropylene, for example), and provided with an inwardly extending protrusion or pawl 25 at the downward or open end thereof to engage an inwardly stepped notch 15 formed around the circumference of the cap 11 immediately below the cylindrical housing 14 to provide fluid-tight contact between inner walls of the cup-shpaed member 23 and the upper end of the sealing body 22 and the outer surface of the housing 14. The protrusion 25 may, of course, be in the form of a ring extending around the periphery of the open end of the cup-shaped member 23 or in the form in a plurality of divided sections.

The inner diameter of the cover member 23 is selected to be substantially equal to the outer diameter of the cylindrical housing 14 to provide a snug fit between them. With the pawl 25 being engaged with the notched portion 15, the cover member 23 is firmly secured in position with its top wall 24 acting as a pressure member providing a downward pressure contact with the top face of the sealing body 22.

With the above arrangement, the sealing body 22 is downwardly depressed by means of the cover member 23 so that it provides an intimate contact with the surfaces of the conductor 20 and the interior of the cylindrical housing 14. This ensures against intrusion of water into the terminals 13 and 21 and thus prevents leakage of high tension voltage. The sealing body 22 is thus substantially isolated from the outside, so that oxidation of the sealing body is prevented to assure its elasticity for an extended period of time.

Figure 2:
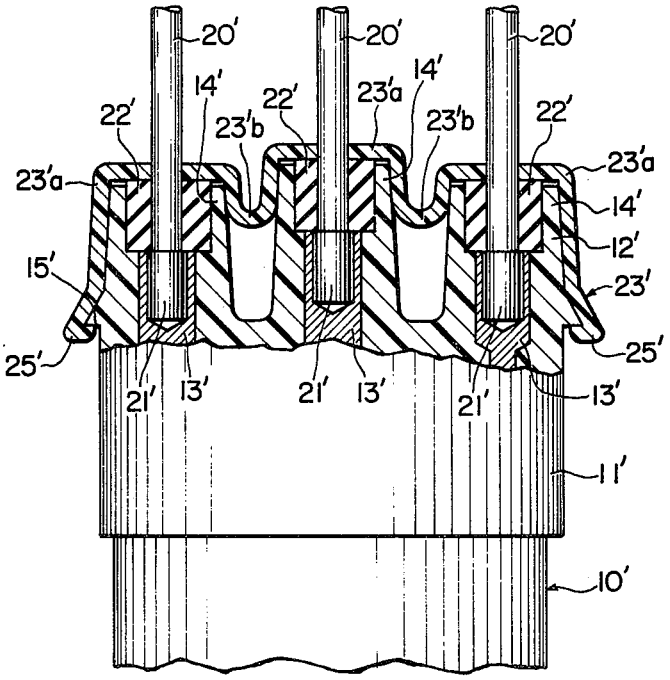
FIG. 2 is an illustration of a partially broken view of a second embodiment of the invention.

FIG. 2 is an illustration of a second embodiment of the invention in which the concept of the invention is applied to an ignition distributor. A cap 11' of an insulative material is mounted on the ignition distributor 10' and provided with a plurality of connecting parts 12' in tower-like configurations, one of which is connected to receive high tension voltage from the distributor 10' and the remainder of which distribute the voltage to the ignition plugs of an engine. In FIG. 2, only three of the connecting parts are illustrated for purposes of simplicity. Each connecting part includes a terminal 13', a housing 14', and a sealing body 22' as constructed in the same manner as in the previous embodiment.

Although it is possible to provide a respective cup-shaped cover member for each of the connecting parts 12', use of a single cover member 23' is preferred for enclosing the whole structure. The cover member 23' is formed with three cup-shaped sections **23'*a* which are respectively positioned to enclose the corresponding connecting parts 12'. More specifically, the top wall of the member 23' is shaped to provide downwardly curved sections 23'*b* which extend between the adjacent walls of the connecting parts 12' so that when the cover member 23' is firmly secured into position with the pawl member 25' being engaged with the notched portion 15', the sealing members 22'** are downwardly depressed by the sectioned top walls of the cover member.

What is claimed is:

1. A connector for an ignition device, comprising a housing which includes a base portion formed with a notch and secured to said ignition device and a cylindrical upstanding portion having an open end at the upper end thereof, a first terminal of a female type embedded in said base portion of the housing below the other end of said upstanding portion and electrically connected to said ignition device, a second terminal of a male type attached to an end of a conductor which extends through the interior of said upstanding portion of said housing to make an electrical connection with said female terminal, the inner diameter of said upstanding housing portion being greater than the inner diameter of said female terminal and the diameter of said male terminal being greater than the diameter of said conductor, an insulative sealing body of an elastic material axially extending from said open end to the other end of said upstanding portion and radially extending from the circumference of said conductor to the inner walls of said upstanding portion to fluid-tightly seal said conductor, and a cup-shaped member of an insulative material having a pawl for engaging the notch of said base portion to hold the cup-shaped member in pressure contact with said sealing body so that the sealing body maintains an intimate, fluid-tight contact with the surface of the conductor and the inner walls of said upstanding housing portion.

2. A connector as claimed in claim 1, wherein said ignition device comprises an ignition coil, and wherein said cup-shaped member is in pressure contact with an end face of said sealing body and in fluid-tight contact with the outer face of said housing.

3. A connector as claimed in claim 1 wherein said cup-shaped member is formed of an oxidation resistant material.

4. A connector for an ignition distributor, comprising a plurality of cylindrical upstanding housings open at the upper end thereof and juxtaposed on a base formed with a notch, a plurality of first terminals of a female type electrically connected to said ignition distributor and respectively embedded below the other end of said housings, a plurality of second terminals of a male type attached to conductors which extend through the interior of said housings so as to make electrical connections with respective female terminals, the inner diameter of each said housing being greater than the inner diameter of each said female terminal and the outer diameter of each said male terminal being greater than the outer diameter of each said conductor, a plurality of insulative sealing bodies of an elastic material respectively axially extending from said open end to the other end of each said upstanding housing and radially extending from the circumference of each said conductor to the inner walls of each said housing to fluid-tightly seal said conductors, and a cup-shaped member of an insulative material having a pawl for engaging the notch of said base to hold the cup-shaped member in pressure contact with said sealing bodies so that each of the sealing bodies maintains an intimate, fluid-tight contact with the surface of each conductor and the inner walls of each upstanding housing.

5. A connector as claimed in claim 4, wherein said cup-shaped member comprises a plurality of tower-like structures for respective engagement with said housings.

6. A connector as claimed in claim 4 or 5, wherein said cup-shaped member is formed of an oxidation resistant material.

7. A combination for use in automotive ignition systems, comprising a source for generating a high tension spark current, a housing structure which includes a base portion formed with a notch and a plurality of cylindrical upstanding portions each having an open end at the upper end thereof, a first terminal of a female type embedded in said base portion below the other end of each said upstanding portion and electrically connected to said source, a second terminal of a male type attached to an end of a conductor which extends through the interior of each said upstanding portion of the housing structure to make electrical connections with said female terminals for carrying said spark current, the inner diameter of each said housing portion being greater than the inner diameter of said female terminal and the outer diameter of said male terminal being greater than the outer diameter of each said conductor, a plurality of sleeves each formed of an elastic, insulative material disposed around each said conductor within each said cylindrical upstanding portion of the housing structure and axially extending from said open end to the other end of each upstanding housing portion and radially extending from the circumference of each conductor to the inner walls of each upstanding housing portion for fluid-tightly sealing said conductors, and a cup-shaped member of an insulative material having a pawl for engaging the notch of said base portion to hold the cup-shaped member in pressure contact with each said sleeve so that each said sleeve maintains an intimate, fluid-tight contact with the surface of each said conductor and the inner walls of each said upstanding housing portion.

8. A combination as claimed in claim 7, wherein said cup-shaped member is formed of a material which is resistant to oxidation.

9. A connector as claimed in claim 7, wherein each said upstanding housing portion has an inner diameter larger than the outer diameter of said first terminal.

10. A connector as claimed in claim 7, wherein each of said sleeves has an axial dimension greater than that of its respective upstanding housing portion so as to thereby extend beyond the open end of said upstanding portions and provide pressure contact with said cup-shaped member.

* * * * *